US006132273A

United States Patent [19]

Nakayama et al.

[11] Patent Number: 6,132,273

[45] Date of Patent: Oct. 17, 2000

[54] COWLING FOR OUTBOARD MOTOR

[75] Inventors: Manabu Nakayama; Tomohiro Nozawa, both of Shizuoka, Japan

[73] Assignee: Sanshin Kogyo Kabushiki Kaisha, Japan

[21] Appl. No.: 09/057,732

[22] Filed: Apr. 9, 1998

[30] Foreign Application Priority Data

Apr. 9, 1997 [JP] Japan ..... 9-105434

[51] Int. Cl.[7] ..... B63H 20/32

[52] U.S. Cl. ..... 440/77

[58] Field of Search ..... 440/78, 88; 123/195 P, 123/195 C

[56] References Cited

U.S. PATENT DOCUMENTS

| | | | |
|---|---|---|---|
| 4,126,115 | 11/1978 | List et al. . | |
| 4,379,702 | 4/1983 | Takada et al. . | |
| 4,403,971 | 9/1983 | Kobayashi et al. . | |
| 4,522,602 | 6/1985 | Okazaki . | |
| 4,533,331 | 8/1985 | Bland . | |
| 4,571,193 | 2/1986 | Takada et al. . | |
| 4,632,662 | 12/1986 | Handa . | |
| 4,721,485 | 1/1988 | Suzuki . | |
| 4,869,693 | 9/1989 | Curtis et al. | 440/77 |
| 4,878,467 | 11/1989 | Schmidt . | |
| 4,960,081 | 10/1990 | Atsuumi . | |
| 4,967,704 | 11/1990 | Imaeda . | |
| 4,968,276 | 11/1990 | Hashimoto | 440/77 |
| 4,978,321 | 12/1990 | Ferguson . | |
| 5,046,976 | 9/1991 | Kobayashi et al. . | |
| 5,049,100 | 9/1991 | Yamamoto et al. . | |
| 5,052,960 | 10/1991 | Kato . | |
| 5,181,870 | 1/1993 | Arai et al. . | |
| 5,181,871 | 1/1993 | Hiraoka et al. . | |
| 5,277,633 | 1/1994 | Kato et al. | 440/77 |
| 5,328,395 | 7/1994 | Oishi . | |
| 5,340,343 | 8/1994 | Kawamukai et al. . | |
| 5,445,547 | 8/1995 | Furukawa . | |
| 5,488,939 | 2/1996 | Nakai et al. . | |
| 5,489,227 | 2/1996 | Ishida et al. . | |
| 5,683,277 | 11/1997 | Tsunoda et al. | 440/88 |
| 5,899,778 | 5/1999 | Hiraoka et al. | 440/88 |
| 5,928,043 | 7/1999 | Rinzaki | 440/77 |

FOREIGN PATENT DOCUMENTS

| | | |
|---|---|---|
| 59-100093 | 6/1984 | Japan . |
| 2-212295 | 8/1990 | Japan . |
| 4-166496 | 6/1992 | Japan . |
| 6-16187 | 1/1994 | Japan . |

*Primary Examiner*—Sherman Basinger
*Attorney, Agent, or Firm*—Knobbe, Martens, Olson & Bear, LLP

[57] ABSTRACT

A protective cowling arrangement provides atmospheric air to the engine of an outboard motor for engine cooling and combustion while inhibiting water intake. The protective cowling incorporates one or more air inlets, an air chamber, and ducts of different sizes for permitting atmospheric air to enter the engine compartment. One of these ducts, which is disposed in part above electrical components of the engine, is substantially shorter in length than the other duct. This duct thus has a smaller flow area without unduly restricting air flow through the duct. An air chamber cover is affixed to the engine and shields the ducts to afford further water preclusion.

21 Claims, 12 Drawing Sheets

COWLING FOR OUTBOARD MOTOR

BACKGROUND OF THE INVENTION

1. Field of the Invention

This invention relates to a cowling structure for a marine propulsion engine and, more particularly, to an improved cowling structure for permitting the induction of air for engine operation while inhibiting water from entering the engine compartment.

2. Description of Related Art

A protective cowling of an outboard motor normally contains a powering internal combustion engine of the motor. The cowling insures that the engine and its auxiliaries do not become wet and subject to corrosion. At the same time, however, it is also necessary to provide atmospheric air to the engine for combustion and/or for cooling of the engine and its components. Because the engine requires substantial amounts of airflow for its combustion process, it is necessary to provide air openings in the protective cowling through which air may be drawn from the atmosphere. A wide variety of air induction systems have been proposed for outboard motors which serve the main purpose of providing ample air flow to the engine for combustion while separating water from the inducted air to reduce corrosion and to inhibit the possible fouling of the engine.

Generally, it has been the practice to provide an air inlet opening at the upper rear portion of the cowling through which atmospheric air can be drawn for engine combustion. Such an inlet opening is normally formed in the cowling and opens upward to permit atmospheric air to flow into the interior of the cowling.

The inlet opening also faces rearward so that water splashing and spraying during the operation of the watercraft will not enter the cowling through the opening. The rearward facing air inlet opening, however, can cause a problem in that, when the watercraft is suddenly decelerated, water may splash up and enter the opening.

In addition, normally some form of baffling or labyrinthine type flow arrangement is provided in the inlet device for assisting in separating water from the air that is passing into the interior of the protective cowling. Although such an arrangement can provide some assistance in reducing the flow of large amounts of water into the interior of the protective cowling, this type of construction can actually facilitate the entry of smaller amounts of water into the engine in the form of droplets or spray. This is because baffling arrangements typically increase the airspeed of the intake air, which results in a greater tendency for water to remain suspended in the rushing air, rather than precipitate out of air flowing into the cowling. Moreover, water droplets commonly condense on the surfaces of the labyrinth passages, and are drawn into the protective cowling and deposited upon the surface of or ingested by the engine. In an addition, these complicated configurations are very expensive to manufacture and/or require multiple pieces for the protective cowling.

Certain portions of the engine are more prone to attack from corrosion and damage from the water than others. For example, the ignition system including the spark plugs, spark coils and spark wires, can be seriously affected if water impinges upon them. Misfiring can occur or in extreme situations the actual running of the engine can be interrupted. In a similar manner, the charge forming system (e.g., a carburetor and/or throttle arrangement) can be subject to deterioration if water impinges upon it. Of course, these problems are particularly aggravated if the engine is operated in a marine environment since the salt water will cause more corrosion than fresh water.

While it is possible to restrict the size of the openings in the protective cowling and thereby reduce the total amount of water traveling into the protective cowling, such restrictions would result in higher airspeeds of atmospheric air drawn into the restricted opening. This consequently increases the amount of suspended water ingested by the engine as described above. A restricted air passage can also significantly reduce engine performance, particularly under wide-open, full-throttle conditions.

SUMMARY OF THE INVENTION

This invention is adapted to be embodied in a cowling structure for the power head of an outboard motor for protecting an engine from water contamination while permitting adequate air flow from the atmosphere to the engine for combustion. The cowling structure incorporates one or more rearward facing air inlet openings in the power head cowling, which allows atmospheric air to communicate with the interior of the cowling for supplying air to the engine. A dividing wall insert, located above the engine inside the power head cowling, isolates the outer surfaces of the engine and associated components from the air and/or water drawn through the air inlet openings.

Once air is drawn through the air inlet openings, it enters an air cavity formed by the dividing wall insert and an air cavity cover. Inside of this air cavity, there are provided one or more tubular air connection ducts or towers which draw air from the upper portion of the air cavity. Air drawn into the ducts travels through the opening at the top of the duct, down through the dividing wall insert, and into the engine compartment. Thus, in order for atmospheric air to enter the engine compartment, the air must turn through several angles before it reaches the proximity of the engine and associated components. These turns cause most, if not all, of the water splashing into the air cavity and/or suspended in the atmospheric air to settle/condense out of the air before the air enters the engine compartment, thereby significantly reducing the amount of moisture contacting the engine and associated engine components. The moisture so removed from the air travels down the inclined surfaces of the dividing wall insert and drains from the air cavity to the exterior of the cowling.

In one mode, one of the air connection ducts is disposed closer to electrical components of the engine that require more water protection than other engine components. This opening is made smaller in effective cross-sectional area; however its longitudinal length (i.e., a length in a fore-to-aft direction) is shorter than the longitudinal length of the other opening. This ensures that the flow area of the duct is not so narrow as to increase the surface drag through the duct to a level that restricts air flow through the duct.

Another aspect of the present invention involves an improved and simply structured air inlet device for an outboard motor protective cowling which can separate water from the inducted air and which can be easily assembled and fabricated at less expense. In one mode, the protective cowling comprises a main cowling member that covers and substantially encloses an engine of the outboard motor, except for an opening located at an upper aft end of the cowling. A cover overlies the opening. A dividing wall insert is positioned between the cover and an anterior of the main cowling member and is attached to the main cowling member. The dividing body insert and the cover together define a chamber with an inlet leading into the chamber formed on an exterior of the cowling. At least one air passage extends through the dividing wall insert and places the chamber in communication with the interior of the main cowling member. Air is admitted into the main cowling member through this passage for engine operation. The formation of the chamber by the dividing wall insert and the cover simplifies the fabrication process of the cowling, as compared to prior designs, and therefore reduces the fabrication and manufacturing costs associated with the protective cowling.

Further aspects, features, and advantages of the present invention will become apparent from the detailed description of a preferred embodiment which follow.

BRIEF DESCRIPTION OF THE DRAWINGS

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF PREFERRED EMBODIMENT OF THE INVENTION

Figure 1:
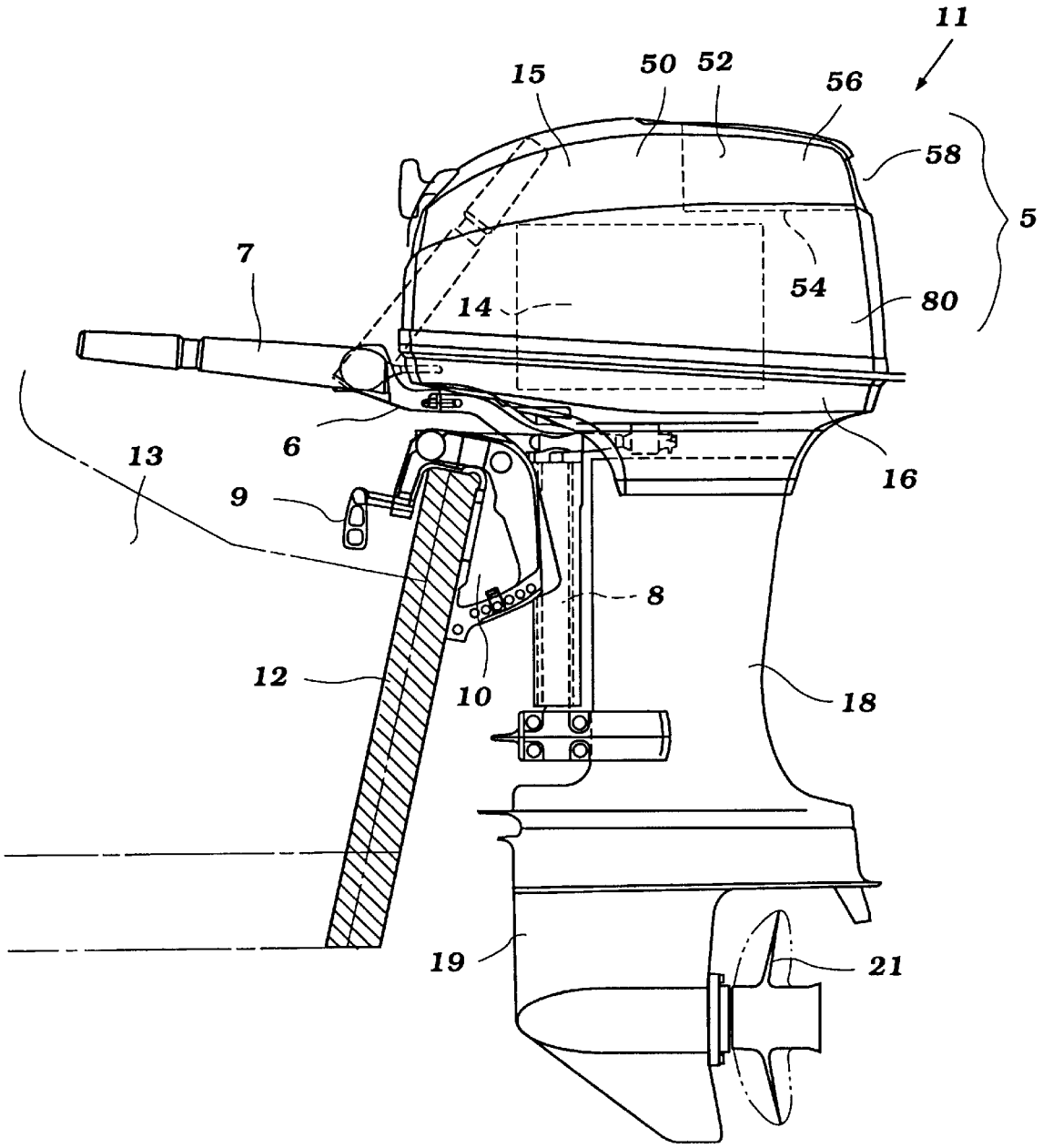
FIG. 1 is a side elevational view of an outboard motor including a power head constructed in accordance with a preferred embodiment of the invention.
Figure 2:
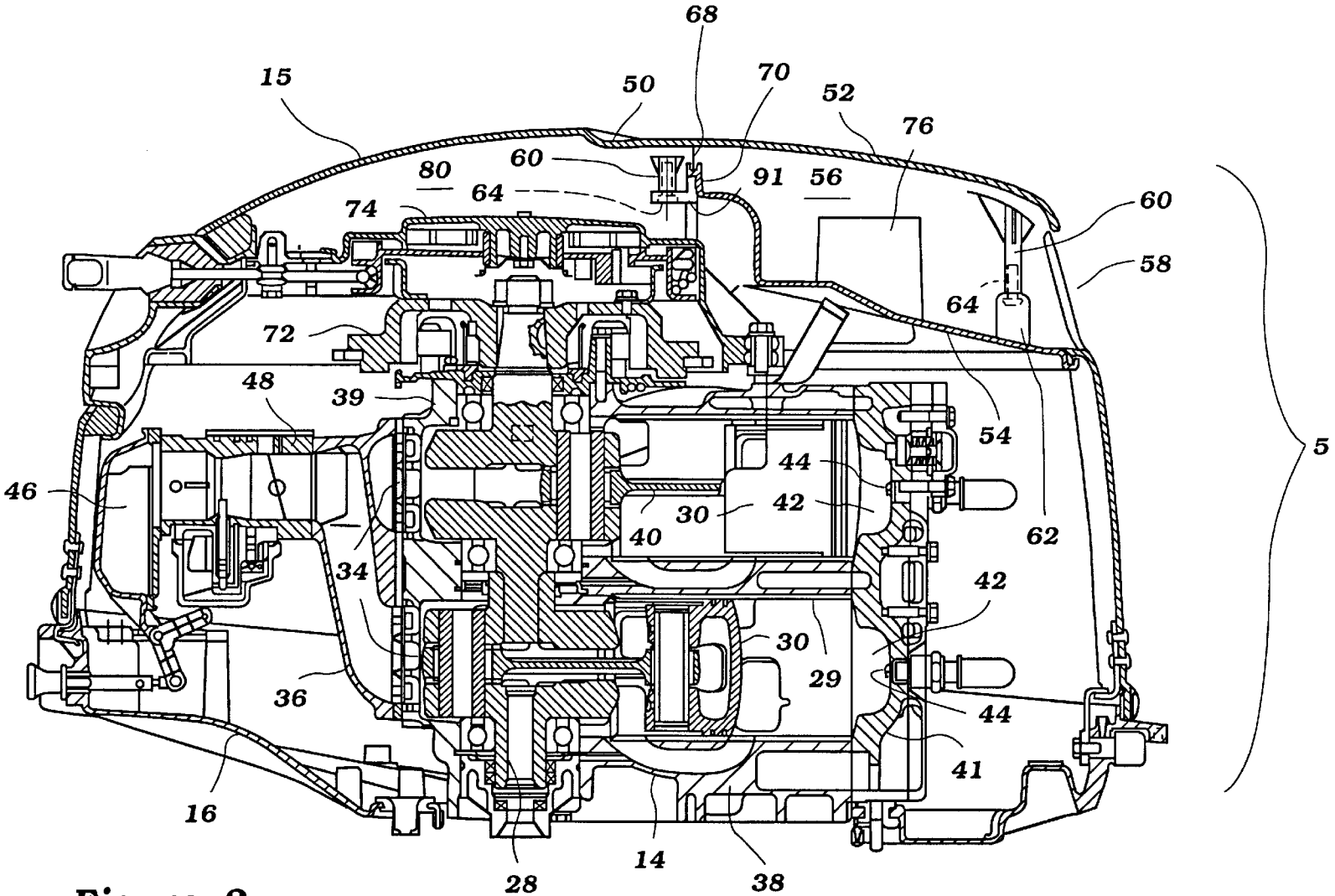
FIG. 2 is an enlarged side elevational view of the outboard motor power head of FIG. 1, and illustrates a protective cowling broken away so as to more clearly show the construction.
Figure 3:
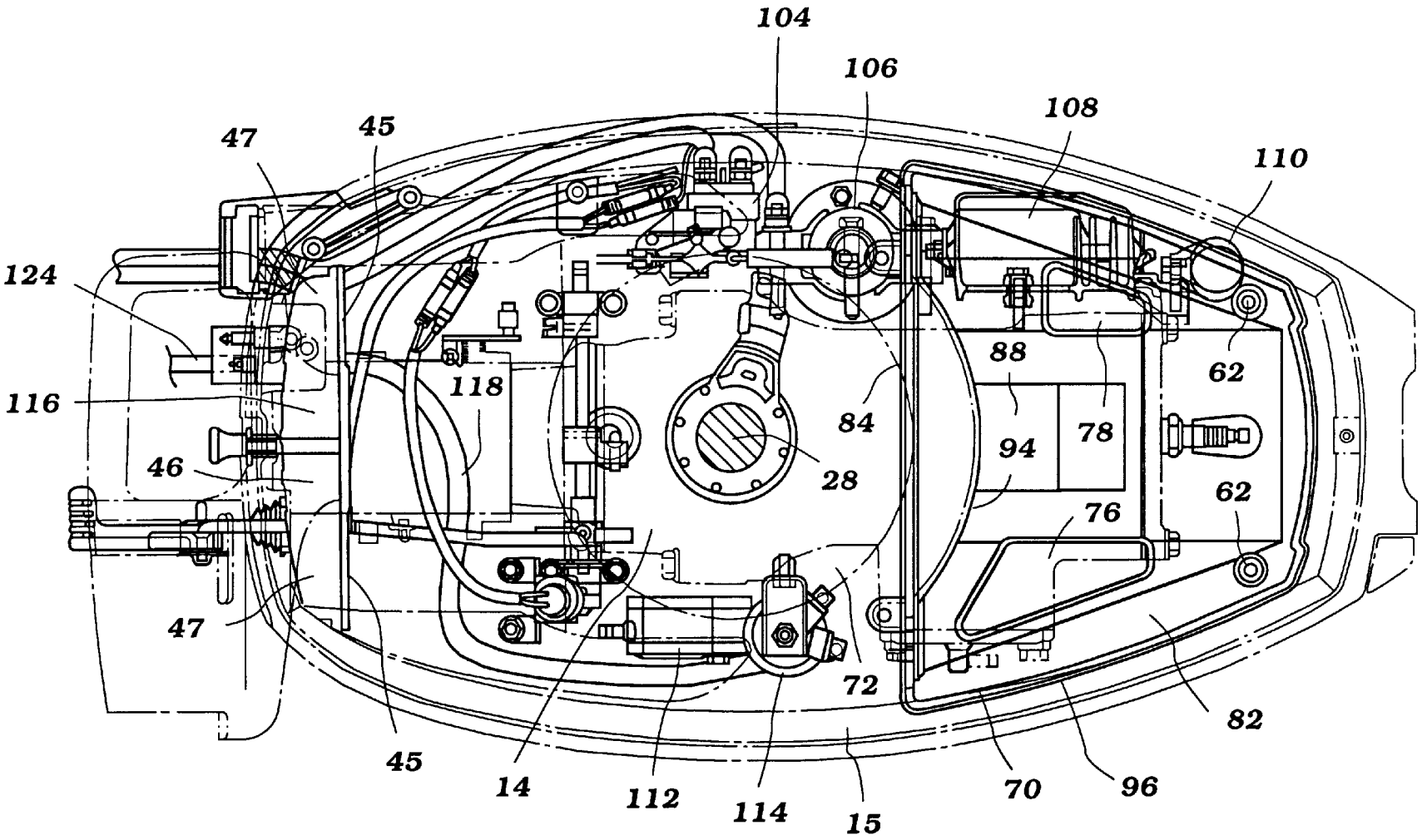
FIG. 3 is a top plan view of the outboard motor power head of FIG. 1, with the protective cowling of the outboard motor shown in phantom.
Figure 4:
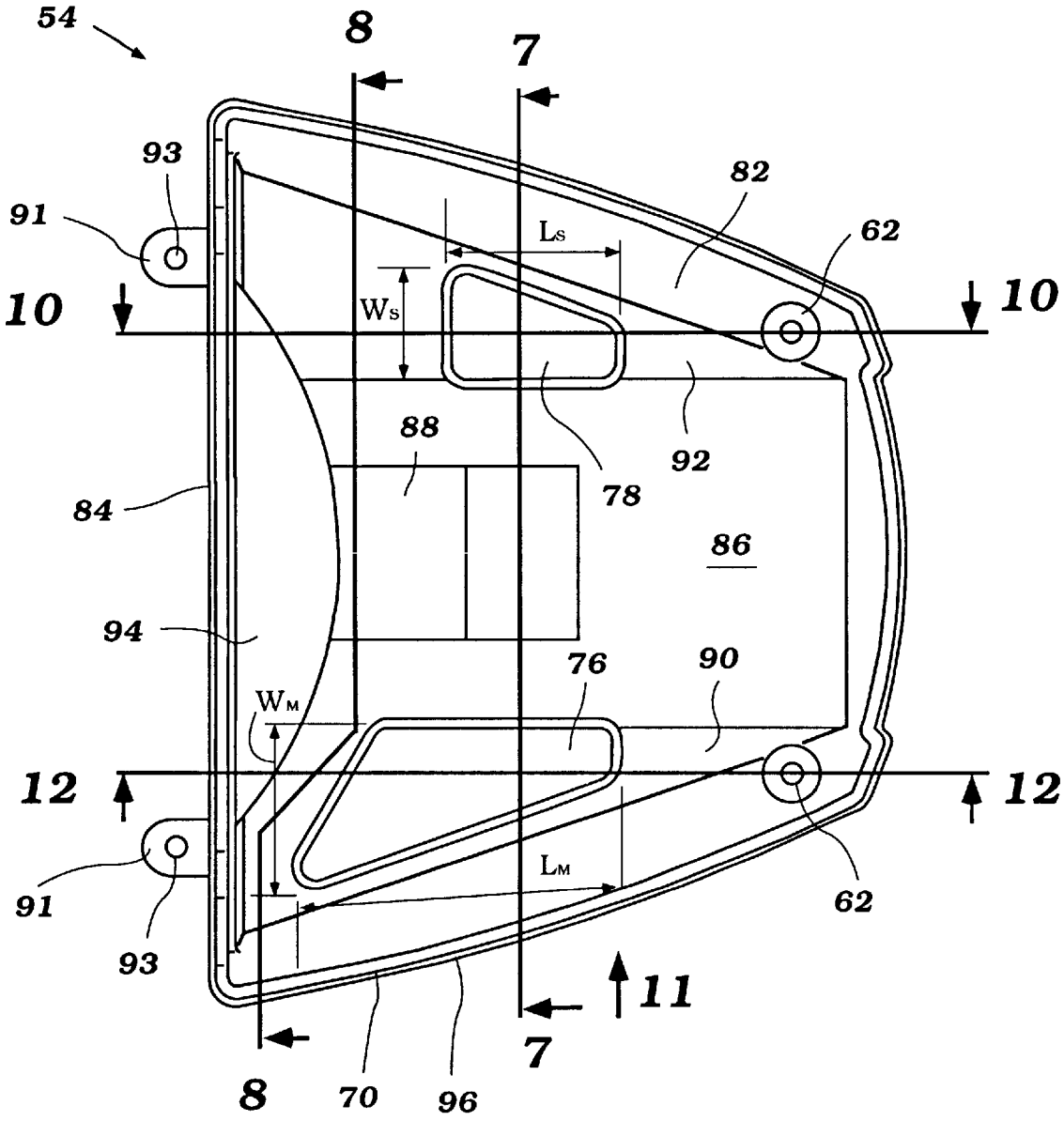
FIG. 4 is a top plan view of the dividing wall insert constructed in accordance with a preferred embodiment of the present invention.
Figure 5:
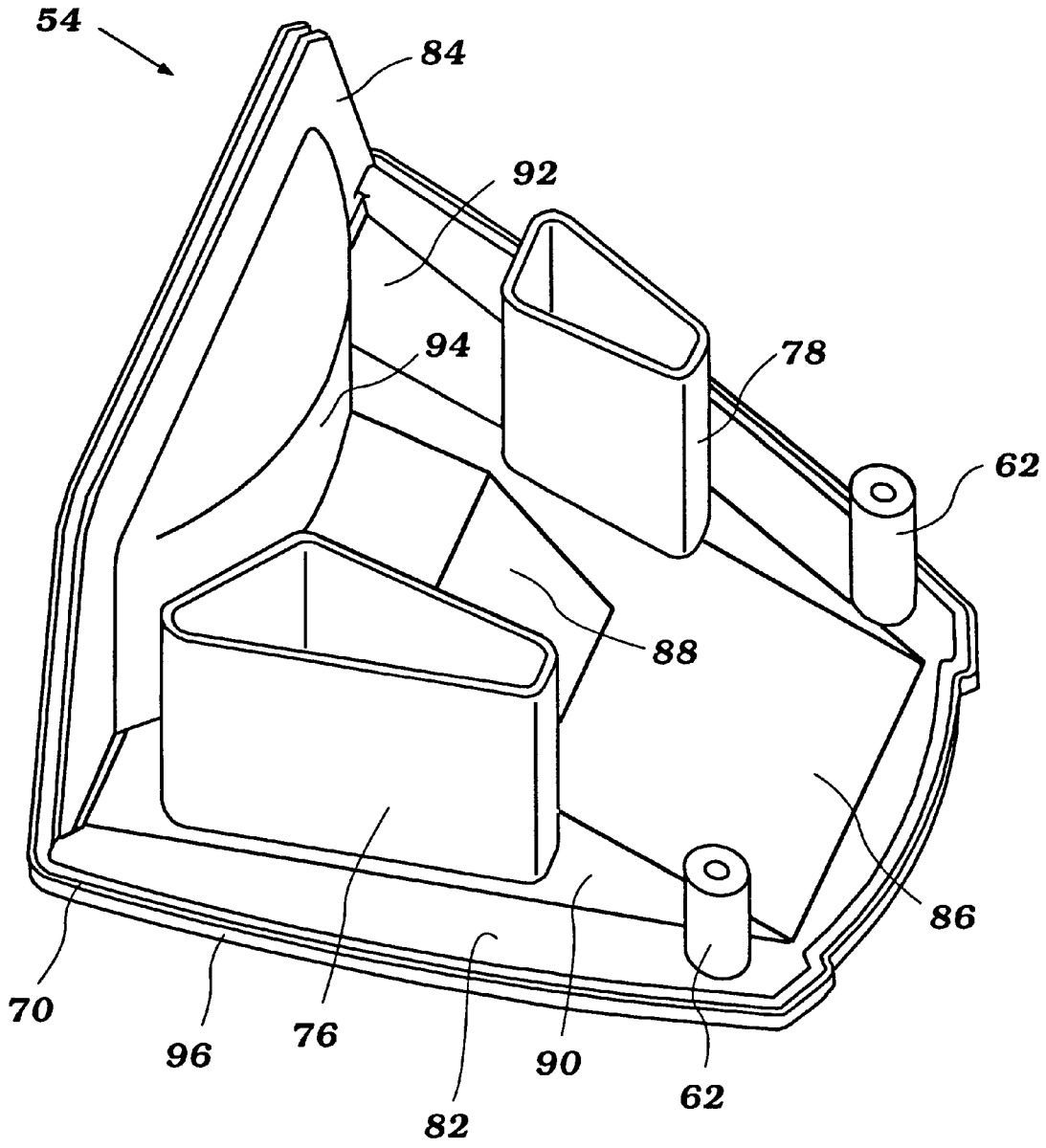
FIG. 5 is an elevated side perspective view of the dividing wall insert of FIG. 4.
Figure 6:
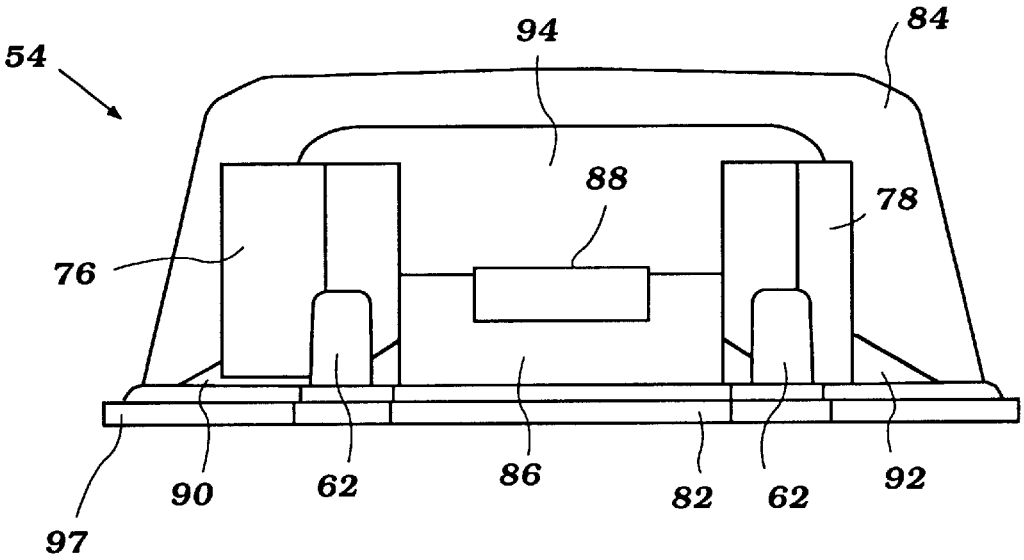
FIG. 6 is a rear view of the dividing wall insert of FIG. 4.
Figure 7:
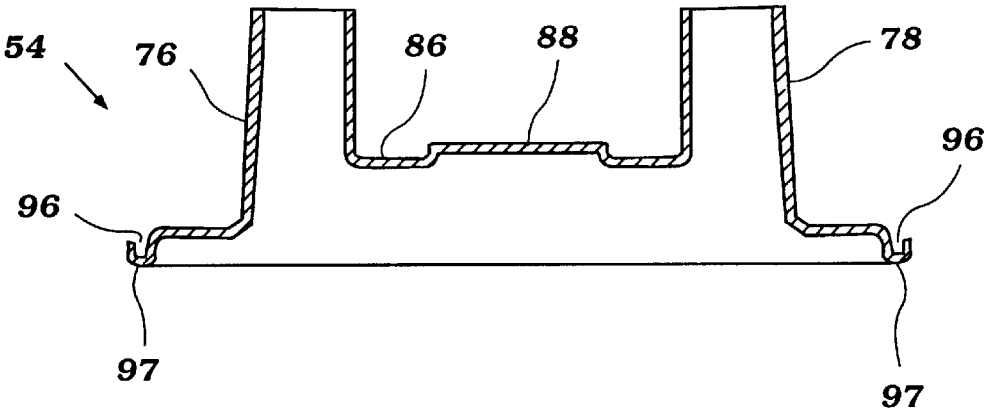
FIG. 7 is a cross-sectional view taken along the line 7—7 of FIG. 4.
Figure 8:
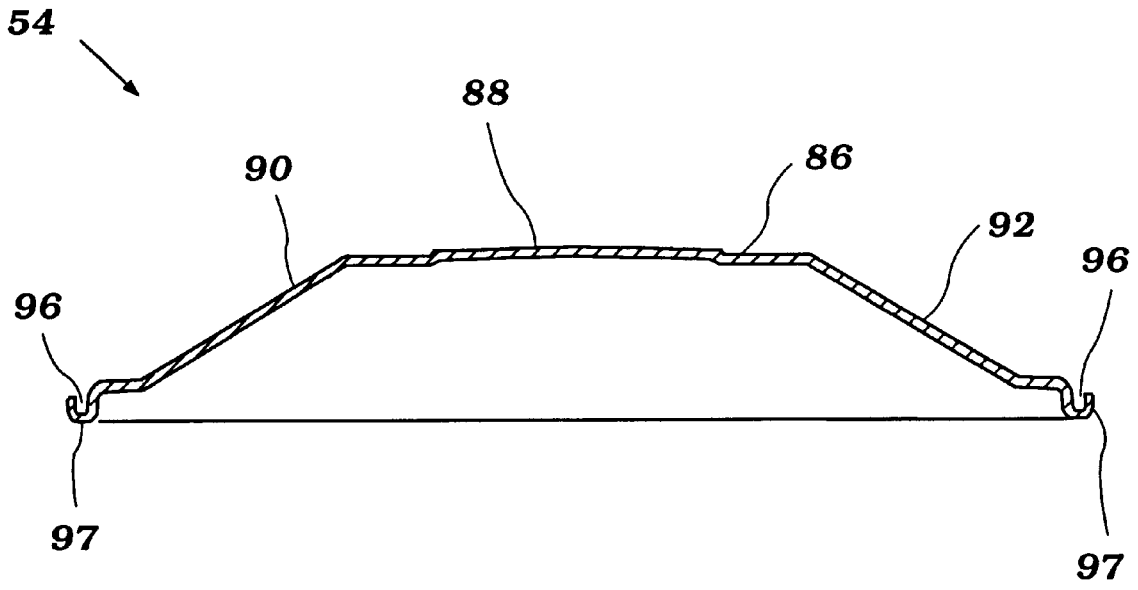
FIG. 8 is a cross-sectional view taken along the line 8—8 of FIG. 4.
Figure 9:
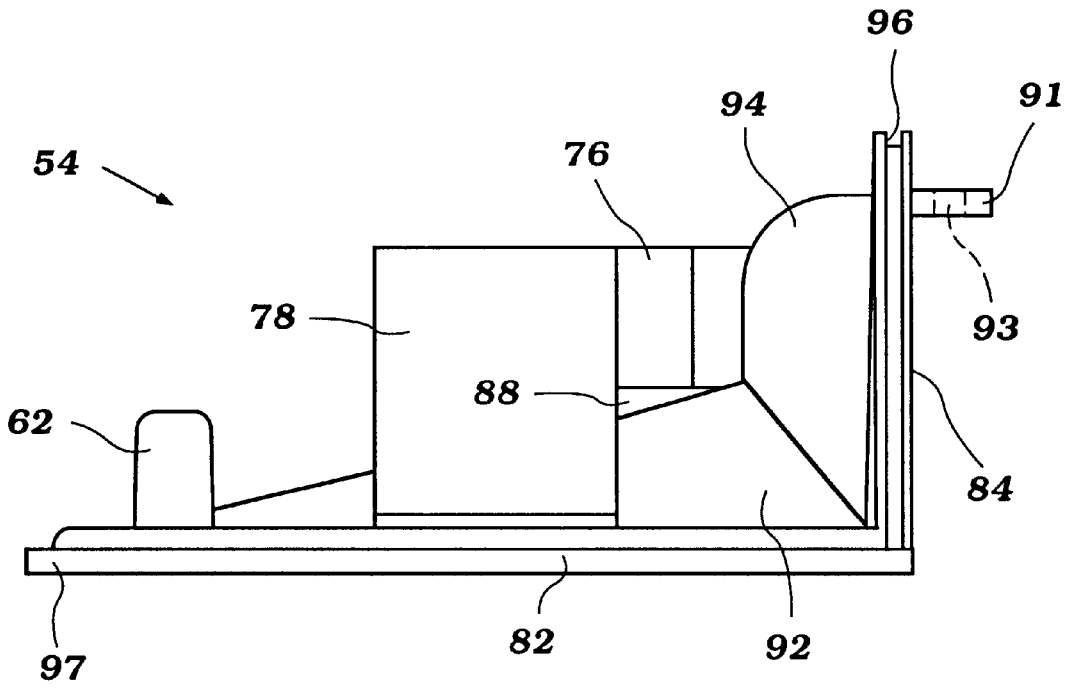
FIG. 9 is a side view of the dividing wall insert of FIG. 4.
Figure 10:
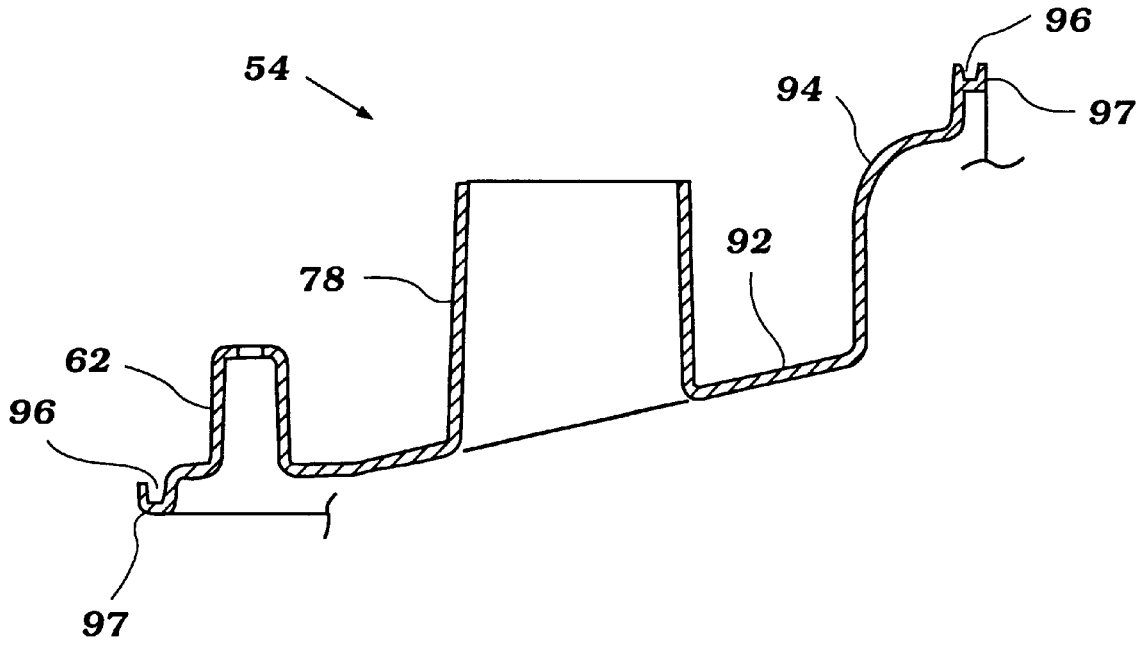
FIG. 10 is a cross-sectional view taken along the line 10—10 of FIG. 4.
Figure 11:
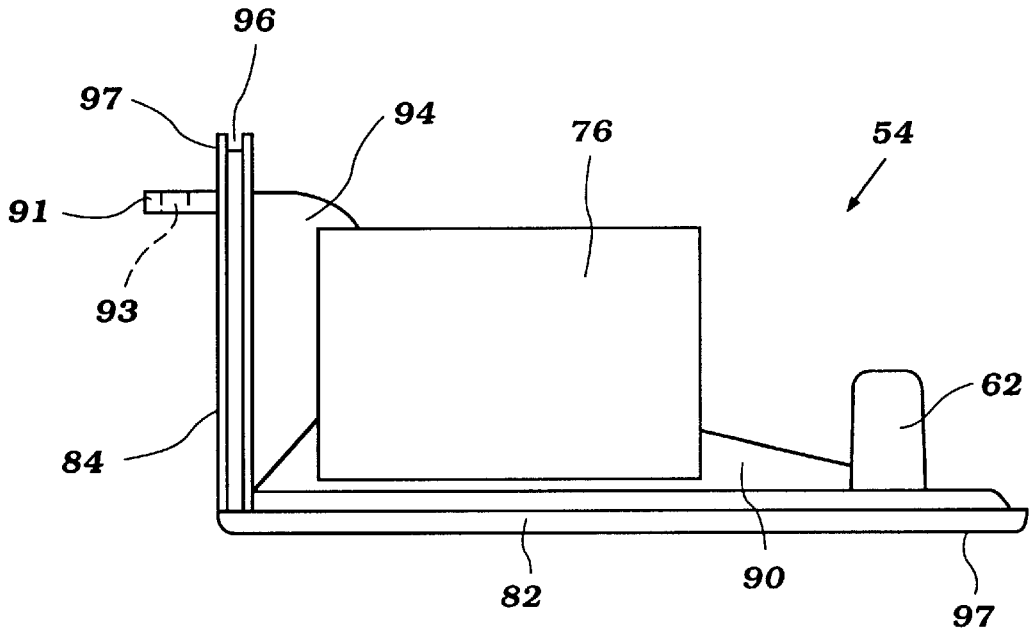
FIG. 11 is an opposite side view of the dividing wall insert of FIG. 4.
Figure 12:
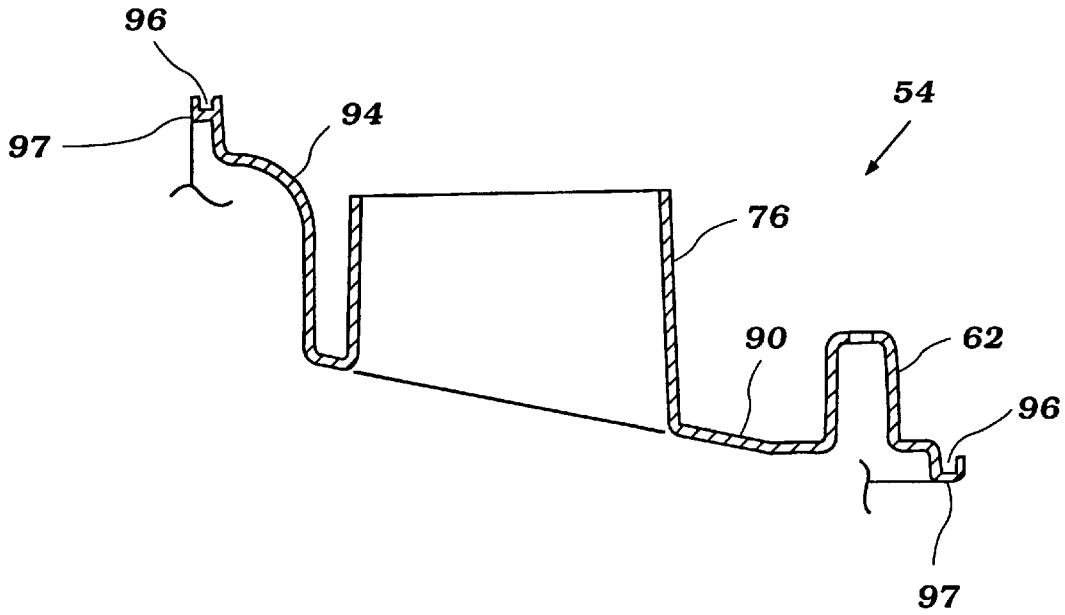
FIG. 12 is a cross-sectional view taken along the line 12—12 of FIG. 4.

With reference now in detail to the drawings and initially to FIG. 1, an outboard motor constructed in accordance with an embodiment of the invention is identified generally by the reference numeral 11. The outboard motor 11 includes a power head, indicated generally by the reference numeral 5, which is comprised of an internal combustion engine 14 and a surrounding protective cowling. The protective cowling is comprised of an main cowling member 15 which is detachably connected to a lower cowling 16 with a sealing gasket (not shown) being interposed between these cowling components. The lower cowling 16, as is typical with this practice, is formed from a light weight, high strength material such as aluminum or aluminum alloy.

The main cowling member 15 is formed from a material which is also light weight such as a molded fiberglass reinforced resin. As will become apparent as the description proceeds, the main cowling member 15 is formed of a multi-part construction. Further details of the main cowling member will be described later.

The engine 14, as is typical with outboard motor practice, has its output shaft rotating about a vertically extending axis. The output shaft connects to a drive shaft (not shown) that is mounted for rotation within a drive shaft housing 18. The drive shaft housing 18 depends from the lower cowling 16 and extends to a lower unit 19. The lower unit 19 contains a forward-neutral-reverse transmission of a known type for selectively driving a propeller 21 in forward and reverse directions. The engine 14 in the illustrated embodiment is depicted as being a two cylinder, in-line engine operating on a two-stroke principle. It will be readily apparent, however, to those skilled in the art how the invention can be practiced with engines of other types.

The outboard motor 11 is shown as attached to the transom 12 of an associated watercraft 13. The drive shaft housing 18 is connected to a pivot mount or swivel bracket 8, which allows the outboard motor to pivot in a manner well known in the art. A tiller 7 is affixed to the outboard motor. The pivot mount 8 is, in turn, connected to a clamping bracket 10 that is held to the transom of the watercraft 13 by a clamp 9.

Although the constructional details of the engine 14 are generally independent of the invention, the layout of certain of the components of the engine 14, and particularly those which may be damaged by water when operating in a marine environment, are important. Thus a general discussion of the construction of the engine 14 will follow primarily by reference to FIGS. 2, 3, 14 and 15, although some of the components also appear in broken lines or in phantom. The engine 14 principally includes a cylinder block 38 in which the cylinders 29 are formed. As has been noted, the engine crankshaft 28 rotates about a vertically extending axis and therefore the axes of the cylinders 29 extend in a generally horizontal plane. Although the invention is depicted in conjunction with an in-line type of engine where the cylinders are vertically spaced from each other, it should be readily apparent to those skilled in the art that the invention may also be employed in conjunction with engines having other cylinder configurations or, in fact, rotary engines.

The pistons 30 in the cylinders 29 are connected by means of connecting rods 40 to the crankshaft 28 for its driving. The crankshaft 28 rotates within a crankcase chamber formed by the lower portion of the cylinder block 38 and a crankcase member 39 that is detachably affixed to the cylinder block 38 in a well known manner. Due to the vertical positioning of the crankshaft, in the illustrated embodiment, the crankcase member 39 is disposed towards the front of the power head 5. Again, however, this is merely a preferred embodiment. A flywheel 72 is secured to the upper end of the crankshaft 28 to limit engine vibration and to provide momentum to the crankshaft 28 to maintain the engine operation in a manner well know to those of ordinary skill in the art. A flywheel cover 74 is positioned above and encloses the flywheel 72.

A cylinder head 41 is affixed to the end of the cylinder block 38 opposite from the crankcase member 39 and at the rear of the power head 5. Since the engine depicted is operated on a two-stroke cycle, the intake and exhaust passages for the engine 14 are formed in the individual cylinder walls in a manner well known to those of ordinary skill in the art. At the top of each of the cylinders 29 is a combustion chamber 42 containing the terminal end of a spark forming device or plug 44.

The engine 14 is also provided with an induction system which includes an air inlet device 46 disposed on one side of the crankcase member 39. In the illustrated embodiment, the induction system lies on a fore or front end of the engine. The air inlet device 46 defines a plenum chamber that has a width (in a side-to-side direction) that is wider than the carburetor 48 and the intake passages that communicate with the crankcase chambers. As such, side sections 47 of the intake device project to either side of the carburetor. An air inlet opening 45 is formed on each of the side sections 47, and each of the inlet openings 45 are formed on a rear surface of the side sections 47 so as to face rearward. The engine draws air into the induction system through these openings 45 from the air inside the main cowling member 15.

The air inlet device supplies air to a carburetor 48, which atomizes fuel and mixes it with the atmospheric air in a well known manner. This fuel/air mixture is then drawn into an inlet case 36, and through reed valves 34 in response to fuel/air demands of the engine 14. The fuel/air mixture is then supplied to the engine cylinders in a manner well known to those of ordinary skill in the art.

Except for the construction of the protective cowling and the protection of the engine 14 from water damage, the construction of the outboard motor as thus far described may be considered to be conventional and since the invention deals primarily with the main cowling member 15 and the air inlet system, further details of the construction of the outboard per se are not believed to be necessary to understand the construction and operation of the invention.

The main cowling member 15 has a generally inverted cup-shape and is formed from a suitable material such as a molded fiberglass reinforced plastic or injection-molded resin/aluminum composite. The main cowling member 15 has a generally curved horizontally extending upper surface or engine compartment cover 50 which terminates at approximately two-thirds of the way towards the back of the main cowling member 15. A dividing wall insert 54 forms a recessed horizontally extending surface along the rear one-third of the of the main cowling member 15. The dividing wall insert 54 is affixed to the engine compartment cover 50 by means of a plurality of interlocking projections formed on the engine compartment cover 50 and the dividing wall insert 54. In particular, ribs 68 depend from the main cowling member 15 and fit into corresponding grooves 70 in the dividing wall insert 54.

Figure 13:
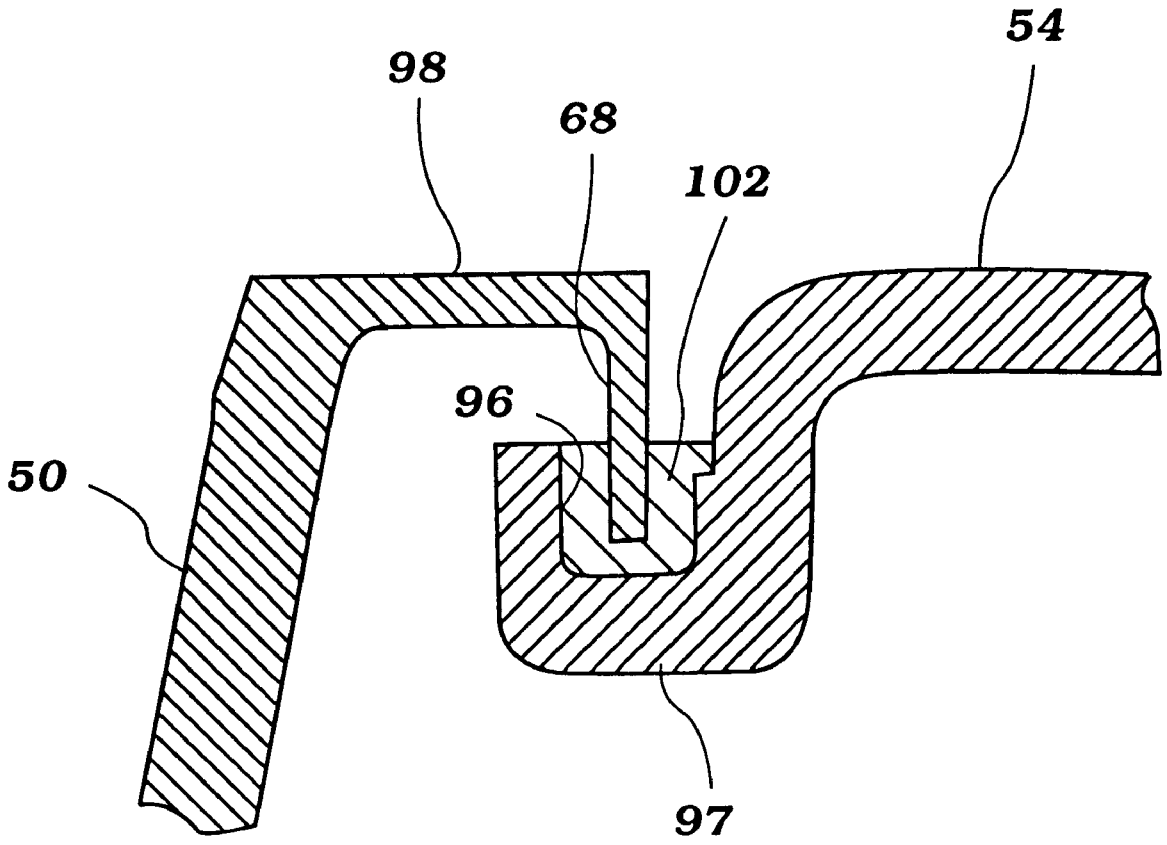
FIG. 13 is an enlarged partial cross-sectional view of the flange of the dividing wall insert and the rib of the main cowling member when the dividing wall insert is in its proper position in the main cowling member.

FIG. 13 depicts an expanded cross-sectional view of the dividing wall insert 54 joined with the engine compartment cover 50. A groove 96, formed at the tip of a peripheral edge 97 of the dividing wall insert 54, substantially surrounds the rib 68 extending from the projecting portion 98 of the engine compartment cover 50. A seal or gasket 102 fills the gap between the flange 96 and the projecting portion 98, thereby forming an essentially watertight seal between the dividing wall insert 54 and the engine compartment cover 50.

An air chamber cover 52, positioned over the dividing wall insert 54, forms an air chamber 56 at the rear of the power head 5. The air chamber cover 52 has a plurality of stems 60 that extend downward from the air chamber cover 52. These stems 60 are fastened to corresponding holes 93 in a plurality of mounts 62 and mounting brackets 91 of the dividing wall insert 54 by screws 64 or other known fastenings (e.g., rivets).

In the illustrated embodiment, a main air connection duct 76 extends upwardly from the dividing wall insert 54, with the top of the duct open to the air chamber 56. In addition, a sub-air connection duct 78 similarly extends upwardly from the dividing wall insert 54, with the top of this duct also open to the air chamber 56. Both of these ducts are hollow, with the bottom of each duct being open to the engine compartment 80, such that atmospheric air in the air chamber 56 may be drawn through the connection ducts 76 and 78 into the engine compartment 80.

With reference now to FIGS. 4 through 12, the dividing wall insert 54 includes a horizontal bottom wall 82, a vertical forward wall 84, an inclined center part 86, a hollow base part 88, an inclined left side 90, an inclined right side 92, and a hollow expanded part 94. The main and sub-air connection ducts 76 and 78 extend upwardly from the sides 90 and 92, respectively, of the dividing wall insert 54.

The main-air connection duct 76 has a longitudinal length $L_m$ (in a fore-to-aft direction) and a transverse width $W_m$. The sub-air connection duct 78 likewise has a longitudinal length $L_s$ and a transverse width $W_s$. The aspect ratio of these air connection ducts is calculated as the width of the duct divided by the length of the duct, i.e., Aspect=W/L. With respect to the sub-air connection duct 78, the aspect ratio is: $Aspect_s=W_s/L_s$. In the disclosed embodiment, the aspect ratio ($Aspect_s$) of the sub-air connection duct 78 is equal to or greater than about 0.25, and more desirably at least equal to about 0.33. An aspect ratio of 0.25 or greater reduces the amount of surface drag on the air flow normally occurring within a small, narrow duct. The smaller sub-air connection duct 78 inhibits water filled air from flowing over sensitive components of the engine (as described in greater detail below) without unduly restricting air flow through it so as to provide a desired cooling effect as the air flows over the components.

Figure 14:
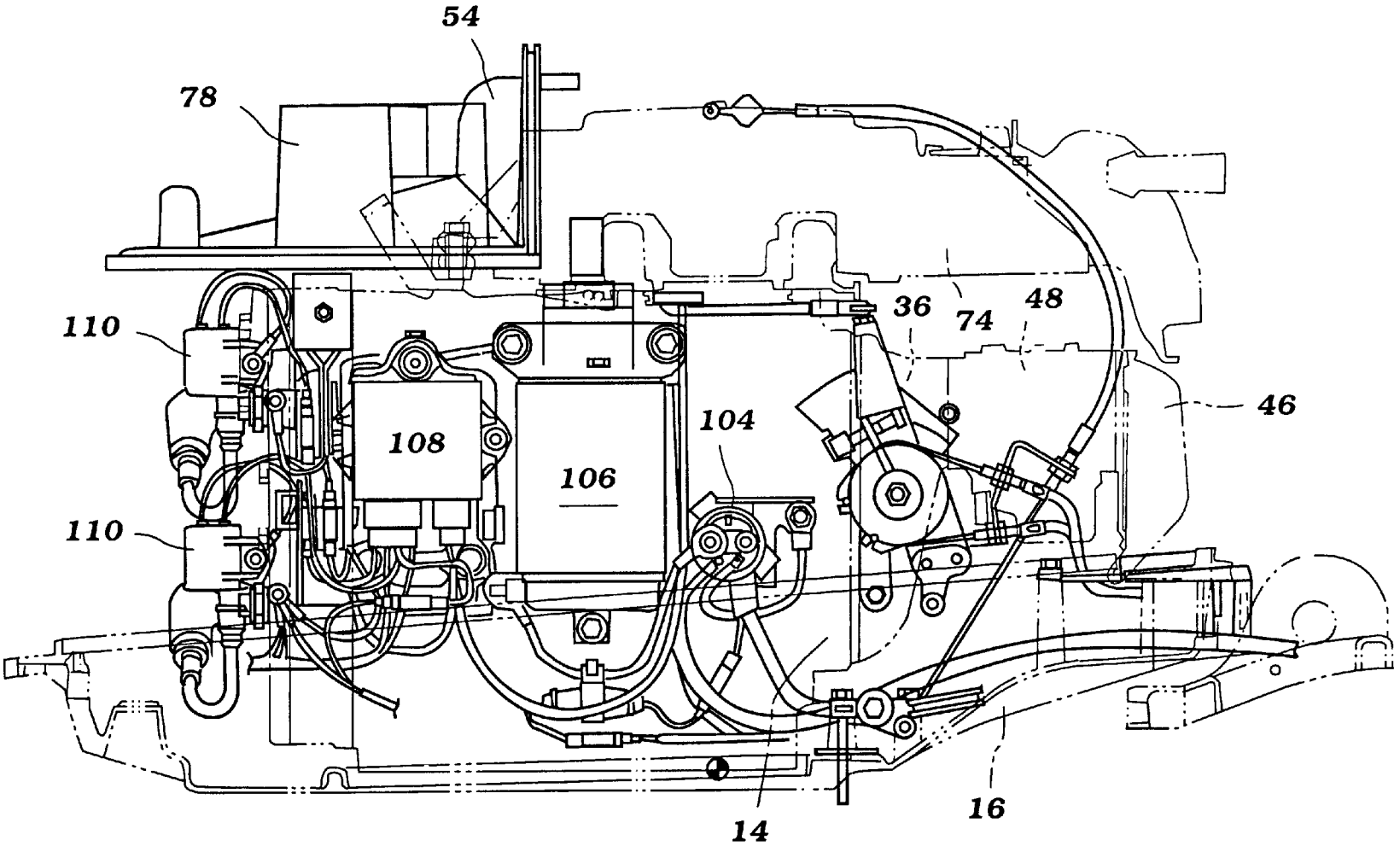
FIG. 14 is a side elevational view of the power head section of FIG. 2, showing various engine components in phantom.

FIG. 14 depicts a number of electrical devices located within the main cowling member 15, including a starter relay 104, a starter motor 106, an electric component control unit 108, and one or more ignition coils 110. These devices are positioned along one side of the engine in a line. This component layout simplifies assembly of the engine. These devices, which are particularly sensitive to water contamination, are also positioned on the side of the engine beneath the sub-air connection duct 78, which, being substantially smaller in cross-section than the main-air connection duct 76, will draw less air and water into the engine compartment than the main-air connection duct 76. Accordingly, less water will impinge upon these devices, and thus the reliability and life of these components will increase under even rough-water operating conditions.

Figure 15:
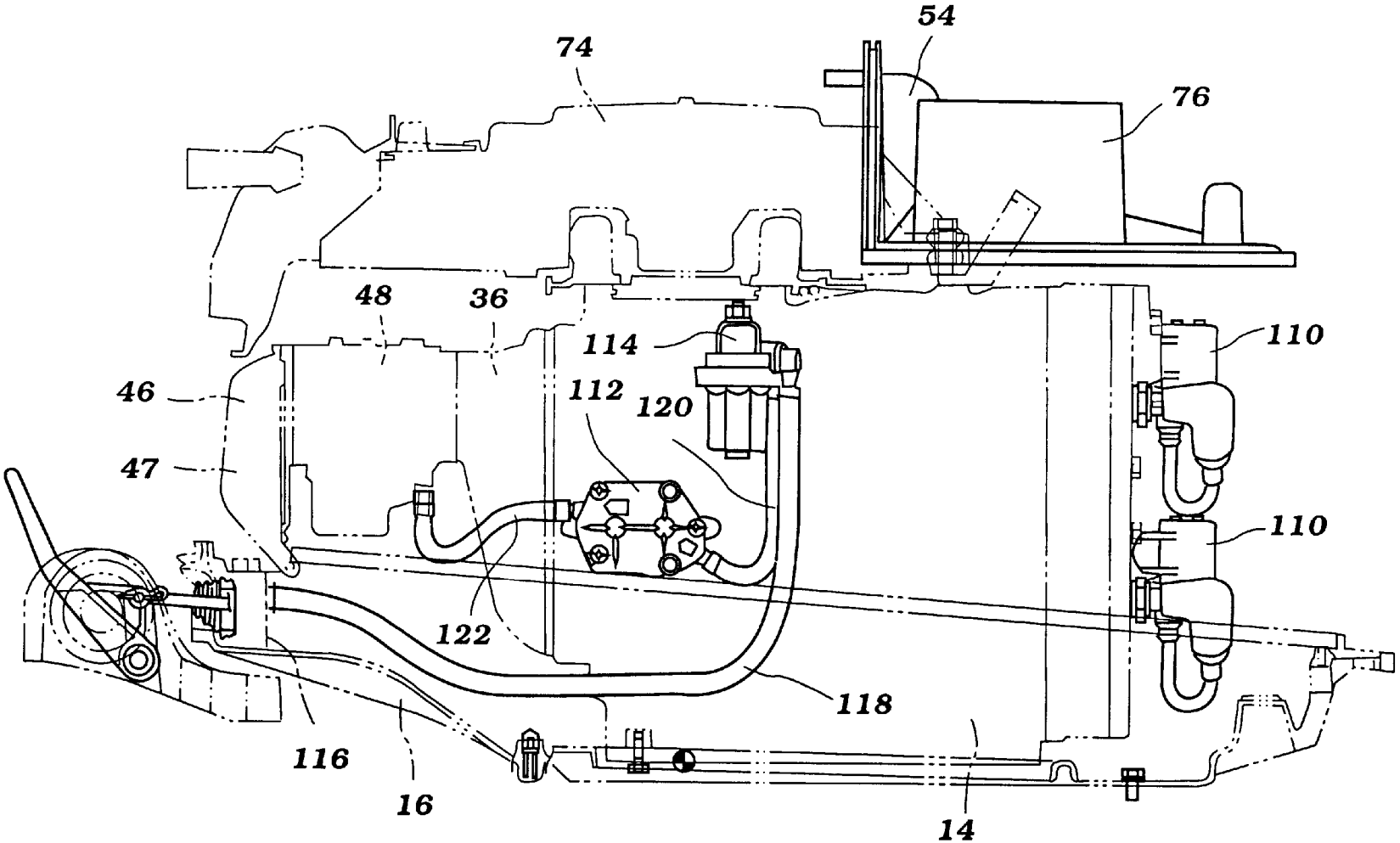
FIG. 15 is an opposite side elevational view of the power head section of FIG. 2, showing various engine components in phantom.

FIG. 15 depicts a number of components associated with the fuel supply system of the engine 14, which are also located within the main cowling member 15. These components are a fuel pump 112, a fuel filter 114, a fuel inlet port 116, and fuel hoses 118, 120, 122 and 124. The fuel pump is a diaphragm-type pump that is exceedingly well known in the art. As opposed to the electric devices of FIG. 14, these fuel supply system components do not utilize electrical power and are thus far less susceptible to water contamination than their electrical counterparts. Accordingly, these devices are positioned on the side of the engine underneath the main-air connection duct 76 which, being of a larger diameter than the sub-air connection duct 78, has a tendency to draw a larger amount of water into the engine compartment than the sub-air connection duct 78.

Air which enters the air inlet opening 58 is channeled by the surfaces of the dividing wall insert 54 towards the front wall 84 of the air chamber 56, where the air is then redirected upwardly by the front wall toward the under surface of the air chamber cover 52. This air then must turn and flow downward through the main or sub-air connection ducts 76 and 78, into the engine compartment 80, for ultimate induction into the engine 14. Thus, it should be readily apparent that the air must turn through several angles before it contacts the outer surfaces of the engine and associated components in the interior of the protective cowling. Water which splashes into the air inlet opening 58 will not be able to travel directly into the engine compartment 80, but must rather turn through several angles before it can enter the engine compartment 80. Accordingly, most if not all water splashed into the air inlet opening 58 will remain in the air chamber 56, with the inclined bottom surface of the dividing wall insert 54 eventually causing this trapped water to drain back out the air inlet opening 58 or another drain provided at the lower aft end of the chamber 56.

Water suspended in the air, in the form of vapor or particles, will be condensed primarily by their impingement on the dividing wall insert 54 and the outer vertical surfaces of the air connection ducts 76 and 78. Due to the force of gravity, this condensed water will flow to the lowest point in the air chamber, and will eventually drain back out of the air inlet opening without contaminating the engine compartment.

It should also be noted that the rearward positioned air inlet opening 58 also provides an area where an operator may put his hand so as to assist in tilting the outboard motor 11 upwards to remove the propeller 21 and lower unit 19 from the water.

It should be readily apparent that the described construction is very effective in providing an ample supply of atmospheric air for the induction of the engine while at the same time separating water and causing the separated water to drain away from the path of air flow and back to the atmosphere. Moreover, the positioning of the more sensitive electrical engine components under an air connection duct of reduced cross-section limits the amount of water contamination experienced by these components, thereby greatly increasing their life and reliability. The configuration of the duct, however, does not restrict air flow to a degree that prevents the desired cooling effect achieved by passing the air flow over the electrical components. Also, the main cowling member construction can be more easily molded than prior constructions, as should be readily apparent, and only a three piece construction is required so as to achieve these purposes.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An outboard motor comprising a power head including an internal combustion engine having a plurality of electrical components positioned on a first side between fore and aft ends of the engine, and a protective cowling including a main cowling member that covers and substantially encloses the engine, first and second air ducts standing generally upright above at least a portion of the main cowling member and communicating with an interior of the main cowling member to admit air into the cowling for engine operation, and a cover connected to the main cowling member and overlying the air ducts, the cover and the main cowling member together defining a chamber around the air ducts with an air inlet leading into the chamber, the first air duct having a smaller cross-sectional flow area and a shorter length in a fore-to-aft direction than the flow area and length of the second air duct, the first air duct lying near the first side of the engine.

2. An outboard motor as in claim 1, wherein the chamber formed by the cover and the main cowling member is located on an upper, aft side of the protective cowling.

3. An outboard motor as in claim 1, wherein the air inlet is formed on the cover.

4. An outboard motor as in claim 1, wherein the main cowling member includes a recessed section defined in part by a dividing wall insert that divides the interior of the main cowling member from the chamber.

5. An outboard motor as in claim 4, wherein the air ducts and the dividing wall insert are unitary.

6. An outboard motor as in claim 1, wherein the electrical components are selected from a group of engine elements consisting of a starter relay, a starter motor, an electronic control unit, one or more ignition coils, and one or more fuel pumps, and several of these electrical components are arranged in-line next to each other on the first side between the fore and aft ends of the engine.

7. An outboard motor as in claim 1, wherein the engine comprises an induction system arranged on the fore end of the engine, and the induction system includes an intake silencer that has at least two rearward facing air inlets, one of the inlets being arranged on one side of an intake passage within the induction system, and the other being arranged on an opposite side of the intake passage.

8. A protective cowling as in claim 1, wherein the first air duct has an aspect ratio of width to length of at least about 0.25.

9. A protective cowling as in claim 8, wherein the first air duct has an aspect ratio of at least about 0.33.

10. A protective cowling for the power head of an outboard motor having an internal combustion engine, the cowling comprising a one-piece main cowling member that is configured to substantially cover the engine, the main cowling member including a substantially closed upper end and an open lower end, an opening located on an upper aft end of the cowling, a cover overlying the opening, an internal mounting member, and a dividing wall insert positioned between the cover and an interior of the main cowling member, the dividing wall insert including a front wall section extending across a width of the dividing wall insert to block air flow in a fore direction along the cover, and an insert mounting member adapted to correspond with the cowling mounting member, at least a portion of the insert mounting member being disposed beneath the cowling mounting member when the dividing wall insert is attached to and within the cowling, the dividing wall insert and the cover together defining a chamber having a front side, an inlet leading into the chamber from an exterior of the cowling, the front wall section closing the front side of the chamber, and at least a first air passage through the dividing wall insert that places the chamber in communication with the interior of the main cowling member, whereby air is admitted into the main cowling member through the passage for engine operation.

11. A protective cowling as in claim 10, wherein at least one rib couples the dividing wall insert to the main cowling member.

12. A protective cowling as in claim 11, wherein a gasket is positioned between the dividing wall insert and the main cowling member.

13. A protective cowling as in claim 10 additionally comprising an upstanding air duct attached to the dividing wall insert and communicating with the first air passage.

14. A protective cowling as in claim 13, wherein the air duct and the dividing wall insert are unitary.

15. A protective cowling as in claim 10, wherein the inlet is formed in the cover.

16. A protective cowling as in claim 10, wherein the dividing wall insert includes at least a second air passage which has a smaller cross-sectional flow area than the first air passage and has a shorter length in a fore-to-aft direction.

17. A protective cowling as in claim 16, wherein the second air passage has an aspect ratio of width to length of at least about 0.25.

18. A protective cowling as in claim 17, wherein the second air passage has an aspect ratio of at least about 0.33.

19. A protective cowling as in claim 10, wherein the cover comprises a member formed independently from the main cowling member.

20. A protective cowling as in claim 10, wherein the cowling mounting member and insert mounting member comprise interlocking projections.

21. A protective cowling as in claim 10, wherein the dividing wall insert has an outer perimeter and engages the main cowling member about substantially the entire outer perimeter of the dividing wall insert.

* * * * *